US006689023B2

(12) United States Patent
Baumler

(10) Patent No.: US 6,689,023 B2
(45) Date of Patent: Feb. 10, 2004

(54) MULTI-EXERCISE GYM SYSTEM

(75) Inventor: Thomas Baumler, Forest Lake, MN (US)

(73) Assignee: Brunswick Corporation, Franklin Park, IL (US)

( * ) Notice: Subject to any disclaimer, the term of this patent is extended or adjusted under 35 U.S.C. 154(b) by 61 days.

(21) Appl. No.: 09/922,306

(22) Filed: Aug. 3, 2001

(65) Prior Publication Data

US 2003/0027697 A1 Feb. 6, 2003

(51) Int. Cl.[7] ..... A63B 23/12
(52) U.S. Cl. ..... 482/100; 482/137; 482/139
(58) Field of Search ..... 482/97–100, 136–138, 482/139, 72, 73, 94–96, 130, 142

(56) References Cited

U.S. PATENT DOCUMENTS 5,971,895 A * 10/1999 Habing 6,394,936 B1 * 5/2002 Voris

* cited by examiner

*Primary Examiner*—Jerome W. Donnelly
(74) *Attorney, Agent, or Firm*—Mayer Brown Rowe & Maw LLP

(57) ABSTRACT

A multi-purpose gym system is disclosed that incorporates a press arm having a main arm and left and right press handles. The exercise machine includes a frame, an exercise station that can include a seat, a pulley system incorporating multiple directional pulleys and a composite pulley, a weight stack, multiple cables engaged with the pulley system and the weight stack, a press arm assembly attached to the cables having a main arm and left and right press handle assemblies having right and left press handles, and a leg extension/leg curl pedestal. The right and left press handle assemblies each include a spring pin for locking them in place and inner and outer stops for limiting travel.

15 Claims, 4 Drawing Sheets

MULTI-EXERCISE GYM SYSTEM

BACKGROUND

1. Field of the Invention

The present invention relates generally to exercise equipment and more specifically to a multi-exercise gym system for use in the home.

2. Description of Related Art

In the past, strength training of the upper torso has been accomplished using a number of different exercise motions using either free weights, such as dumbbells and barbells, or using multiple exercise machines to facilitate the various exercise motions. For example, three common exercise motions using free weights that have long been popular for exercising the chest are the bench press, the dumbbell press, and the dumbbell fly. In the bench press, an exerciser lies supine on a bench and grasps a barbell and pushes the barbell upward in a generally vertical motion. In the dumbbell press, an exerciser lies supine on a bench, grasps dumbbells, and pushes them upward in a converging arc. In the dumbbell fly, an exerciser lies supine on a bench, and grasping dumbbells, extends his or her arms laterally outward, and moves or "swings" them upward in an arc. Although these exercise motions effectively work the targeted muscles, they have certain shortcomings, including limitations on the range of exercise motion and concerns regarding safety of the exercise related to the use of free weights, often requiring an exercise partner, or "spotter," to increase safety.

To overcome the limitations in exercising the upper torso using free weights, machines have been developed to simulate the above-described exercises. These machines are often configured so that the user is in an upright seated position, which is generally more comfortable. The resistance of the machines is provided either by loading the machines with weight plates, or by incorporating a weight stack into the machine that provides resistance either through the use of levers or through a pulley and cable system.

For home use, multi-exercise machines have been developed that break up various upper torso exercises into different "exercise stations." For example, a chest press may be on one station on one side of the machine along with some other body exercises such as leg and or back exercises, and a chest fly may be on another station on another side of the machine.

U.S. Pat. No. 6,080,091 ("the '091 patent") describes a machine for performing converging chest presses and chest fly exercises. This machine has a main arm with a primary axis of rotation hinged from a frame and two secondary axes of rotation hinging from the main arm, wherein the secondary axes of rotation are parallel to one another and perpendicular to the primary axis. No stops are used to limit the amount of rotation of the secondary axes and no pins are used to lock the arms into place for performing fixed arc chest presses. The '091 teaches that, by orientating the secondary axes parallel to one another and in a perpendicular relationship with the primary axis, the secondary arms fall under the force of gravity to a natural starting position for chest exercises.

The exercise machine disclosed in the '091 patent has certain disadvantages that are overcome by the apparatus of the present invention. The machine in the '091 patent does not include stops or a device to pin the secondary arms in a fixed relationship with the primary arm; therefore, a user is unable to perform a fixed arc chest press without lateral resistance, which makes the machine difficult to use. In addition, the lack of stops at the inner point of rotation creates the danger that the users' hands may come in contact with each other or with the machine at the end of a chest fly motion, creating the potential for injury.

The orientation of the axis in the machine disclosed in the '091 patent creates a chest fly exercise and converging press exercise that do not accurately simulate conventional dumbbell fly and press exercises using free weights. For example, the secondary axes are parallel to one another; therefore, at the midpoint of a chest fly exercise, the pivots approximately line up with the axes of the users' shoulders. This causes a "dead spot" in the resistance profile because rotation of the shoulders in this area does not cause translation of the main arm to which the resistance is attached. After the pivots pass by the shoulder, the resistance again increases. In a dumbbell fly, the resistance is greatest at the beginning, and then reduces at a constant rate.

When performing a dumbbell fly while lying supine on a bench, the exerciser moves his or her hands through one plane. Past machines that were created to simulate this motion also moved the users' hands through one plane by lining up the axis of rotation above or below the users' shoulder axis of rotation. However, the orientation of the secondary pivots in the machine of the '091 patent causes the users hands to travel through an upward arc when performing a fly exercise. This upward arc may feel abnormal to the user and adds to stress on the wrists of the user because the angle of the handles is changing throughout the arc.

Thus, for home use, where size limitations and cost considerations are important, it is advantageous to combine as many exercises into one exercise machine as possible, and it is further more desirable to combine as many exercises into a single exercise station on the exercise machine as possible. Therefore, a need exists for an exercise machine that allows an exerciser to perform a number of upper torso exercises from one station, resulting in a relatively small and low cost machine, while still maintaining the advantages and feel of traditional exercise motions, such as the bench press, the dumbbell press, and the dumbbell fly, with the added safety of performing such exercises on an exercise machine.

SUMMARY

The purpose and advantages of the invention will be set forth in, and apparent from, the description and drawings that follow, as well as will be learned through practice of the invention. Additional advantages of the invention will be realized and attained by the elements of the apparatus and methods of using the invention described herein.

In accordance with one aspect of the present invention, a multi-exercise gym machine is provided that incorporates an apparatus for performing fixed arc chest presses, converging chest presses, chest fly exercises, mid rows, and rear deltoid exercises using a constant resistance profile in a single multi-exercise gym system. A main arm is connected to a frame through a primary pivot. Connected to the main arm through secondary pivots are left and right press handle assemblies having press handles. Also connected to the left and right press handles are low row handles (lower handles grasped by the user with palms facing up) and rear deltoid handles (upper handles grasped by the user with palms down and elbows up) for performing back exercises.

The left and right press handle assemblies each contain a spring pin for locking them in place and inner and outer stops for limiting travel. The main arm has a restrictor plate for each press handle assembly that has a hole that the spring pin engages and a slot that a restrictor pin on the press handle assembly engages to act as the inner and outer stops. The secondary pivots are orthogonal to the primary pivot and are angled inward toward each other with an intersection above the primary pivot when viewed from the front. This angle forces the press handles to fall inward and downward together against stops under the force of gravity in an at-rest position.

In the present invention, because the secondary pivots are angled inward, they do not line up with the pivot axis of the shoulder joint of an exerciser when he or she is performing converging presses and fly exercises. Instead, rotation of the left and right press handles translate to movement of the main arm at a constant rate, producing a constant resistance profile. The position and angle of the secondary pivots with respect to the primary pivot also allows for an approximately single plane motion when performing fly exercises because as the main arm arcs upward, the downward angle of the secondary pivots causes the press handles to move downward when brought together, essentially eliminating or greatly reducing arcing motion.

The inner stops of the exercise machine limit the travel of the press handle assemblies to just before the handles come together, protecting the user's hands. This is similar to protection afforded the hands of an exerciser by dumbbells, which is created by the larger diameter of the weights of the dumbbells over a user's hands grasping the axis of the dumbbell. In an alternate embodiment of the present invention, the addition of two sets of handles to the rear of the left and right press handle assemblies also allows the user to perform back and other exercises in addition to chest exercises.

These and other features and advantages of the invention will be apparent upon consideration of the following detailed description of the presently preferred embodiments of the invention, taken in conjunction with the claims and appended drawings, as well as will be learned through the practice of the invention.

DESCRIPTION OF THE PREFERRED EMBODIMENTS

Figure 1:
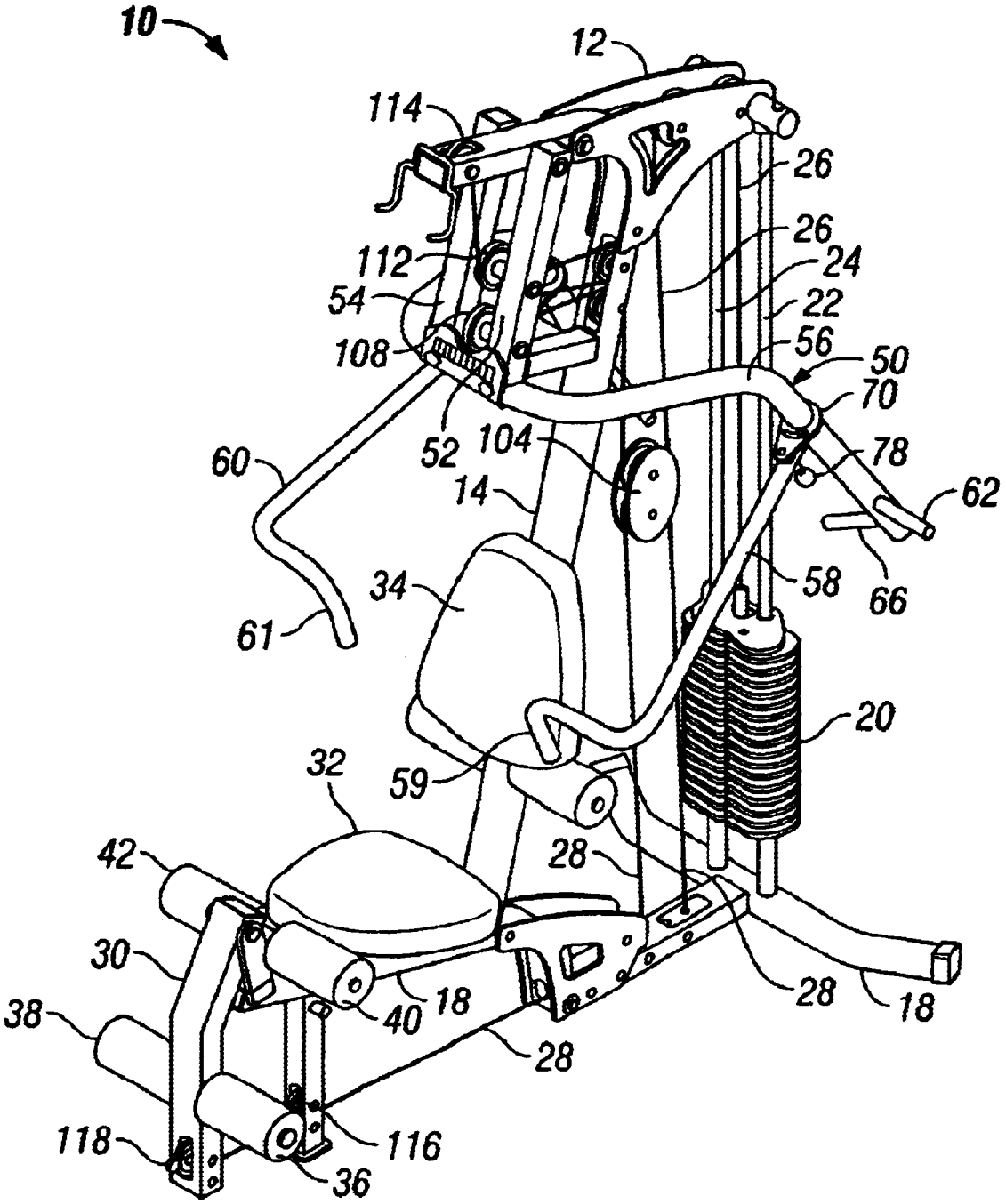
FIG. 1 is a perspective view of an exercise machine incorporating a press arm assembly in accordance with an embodiment of the present invention.

While the invention can be embodied in many different forms, there is shown in the drawings, and will herein be described in detail, a preferred embodiment of the present invention with the understanding that the present disclosure is to be considered as an exemplification of the principles of the invention and is not intended to limit the invention to the embodiments illustrated.

Figure 3:
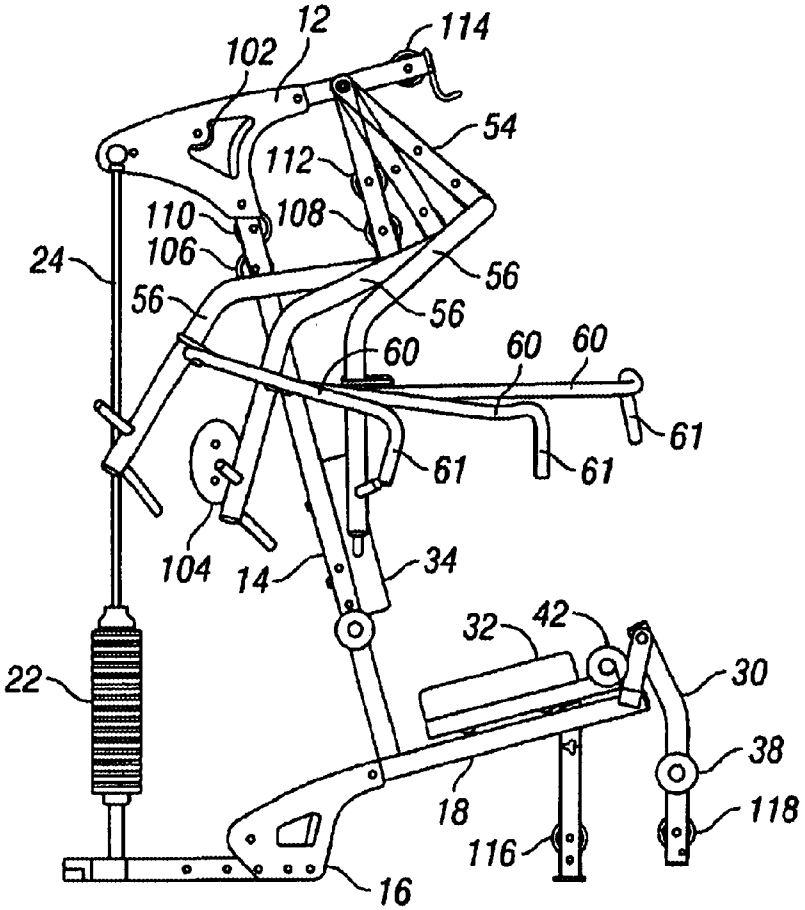
FIG. 3 is a side view an exercise machine incorporating a press arm assembly in accordance with an embodiment of the present invention illustrating the path of motion and the rotation of a main arm and press handles as the press arm assembly moves through a chest fly exercise by showing multiple positions of the press arm assembly (cables not shown)
Figure 2:
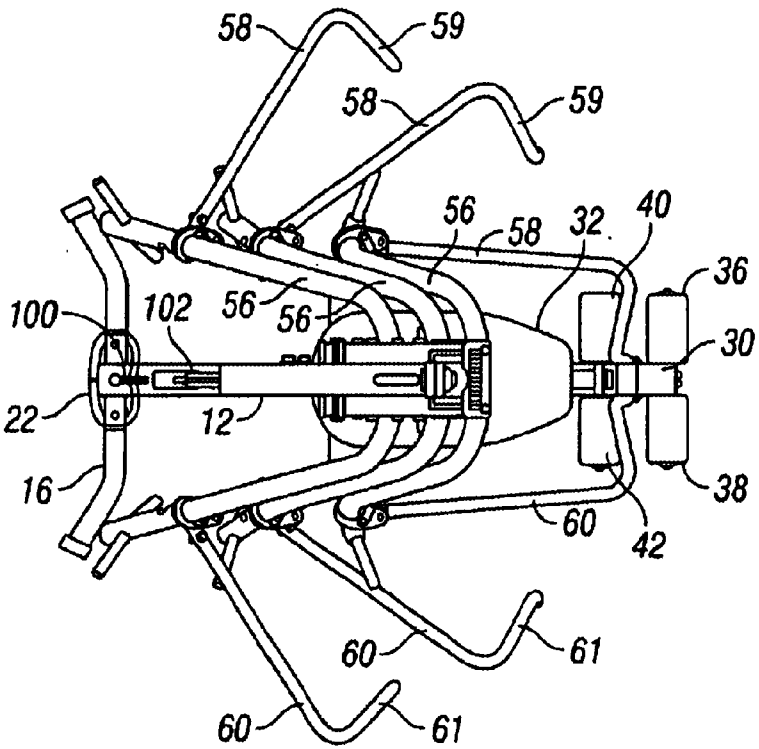
FIG. 2 is a top view an exercise machine incorporating a press arm assembly in accordance with an embodiment of the present invention illustrating the path of motion and the rotation of a main arm and press handles as the press arm assembly moves through a chest fly exercise by showing multiple positions of the press arm assembly (cables not shown)

Referring now to FIGS. 1–3, various views of a multi-exercise gym machine, which is designated generally by the reference character 10, are shown. In accordance with one aspect of the invention, the exercise machine 10 includes a frame, an exercise station that can include a seat, a pulley system incorporating multiple directional pulleys and a composite pulley, a weight stack, multiple cables engaged with the pulley system and the weight stack, a press arm assembly attached to the cables having a main arm and left and right press handle assemblies including multiple handles, and a leg extension/leg curl pedestal. These components will be described in more detail below.

The frame of the exercise machine 10 includes an upper frame 12, a vertical frame 14, a bottom frame 16, and an exercise station frame 18. The frame components 12–18 are bolted together in a manner known in the art and in the configuration illustrated in FIG. 1. The weight stack 20 incorporates multiple weight plates and a bayonet connected to a cable that functionally connects the weight stack to the gym system in a manner that is well known in the art. The bayonet extends through the individual plates of the weight stack 20, and the user can select the number of plates to be lifted by inserting a pin through the weight stack 20 into the bayonet. As a result, the bayonet, along with the selected number of weight plates from the weight stack 20, will move upward when an exercise is performed by a machine user, providing resistance to the exercise motion. The selected number of weight plates will move upward along guide rods 22 and 24 during exercise. Guide rods 22 and 24 are connected between the upper frame 12 and the lower frame 16.

A cable 26 is connected to the weight stack 20 via the bayonet to functionally engage a selected number of weight plates to provide resistance to an exercise motion. Cable 26 extends upward from the weight stack 20 and engages upper directional pulleys 100 and 102 (shown in FIG. 3). Cable 26 then extends to composite pulley 104, directional pulley 106, press arm pulley 108, directional pulley 110, press arm pulley 112, and terminates at overhead pulley 114. The composite pulley 104 is simply two pulleys that work in conjunction with one another, as is known in the art. Composite pulley 104 ties each exercise apparatus together (including the press handles, leg extension/leg curl pedestal, and any other exercise apparatus incorporated into the machine), allowing each separate exercise apparatus to receive resistance from the weight stack. This enables the use of a single weight stack having a single cable attached to the weight stack.

Figure 4:
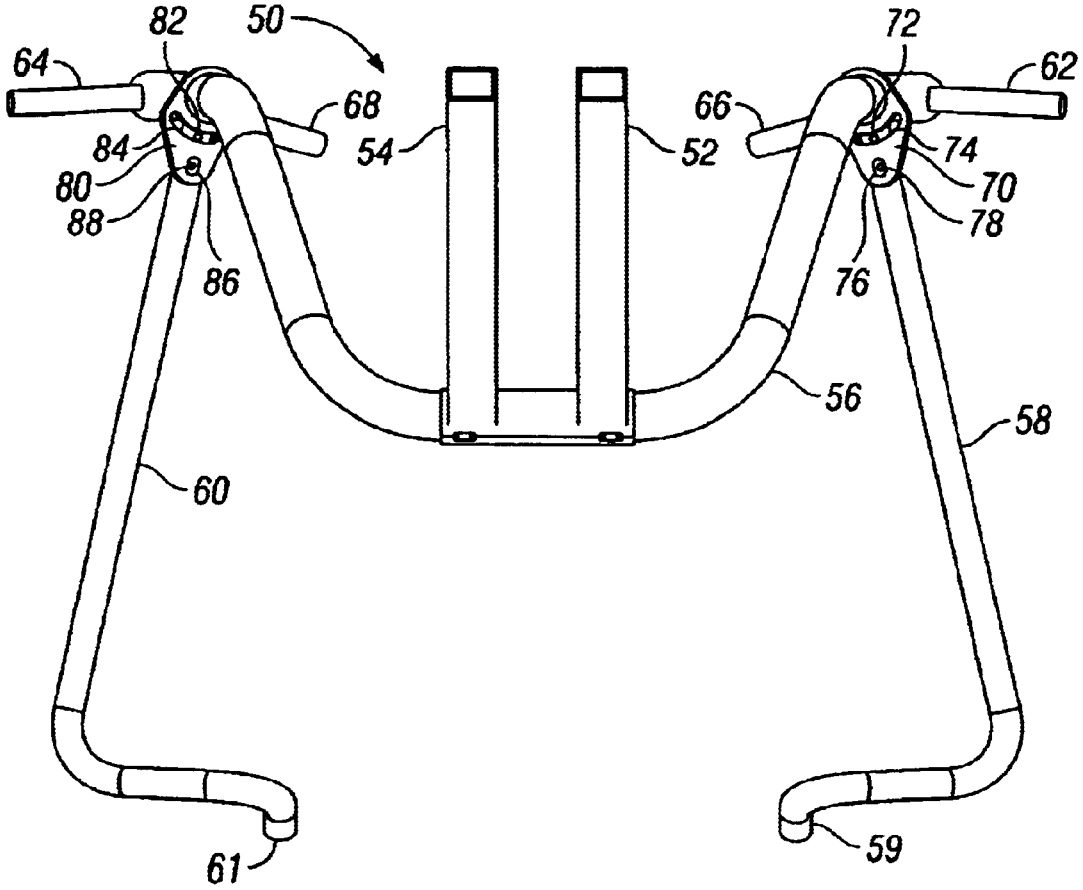
FIG. 4 is a perspective view of a press arm assembly in accordance with an embodiment of the present invention.
Figure 5:
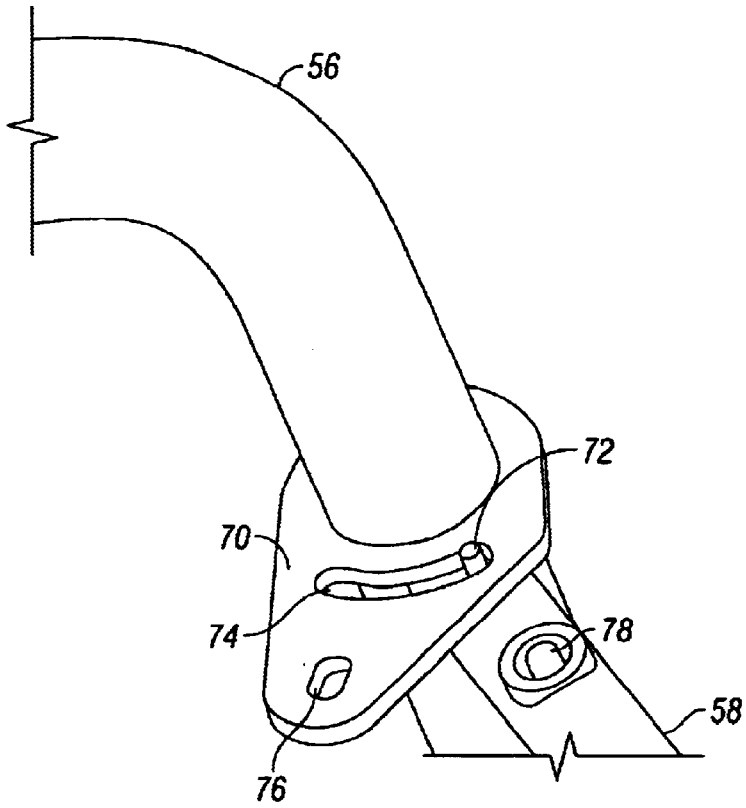
FIG. 5 is a perspective view of a secondary pivot, a pin locking mechanism, and an inner and outer stop in accordance with an embodiment of the present invention.
Figure 6:
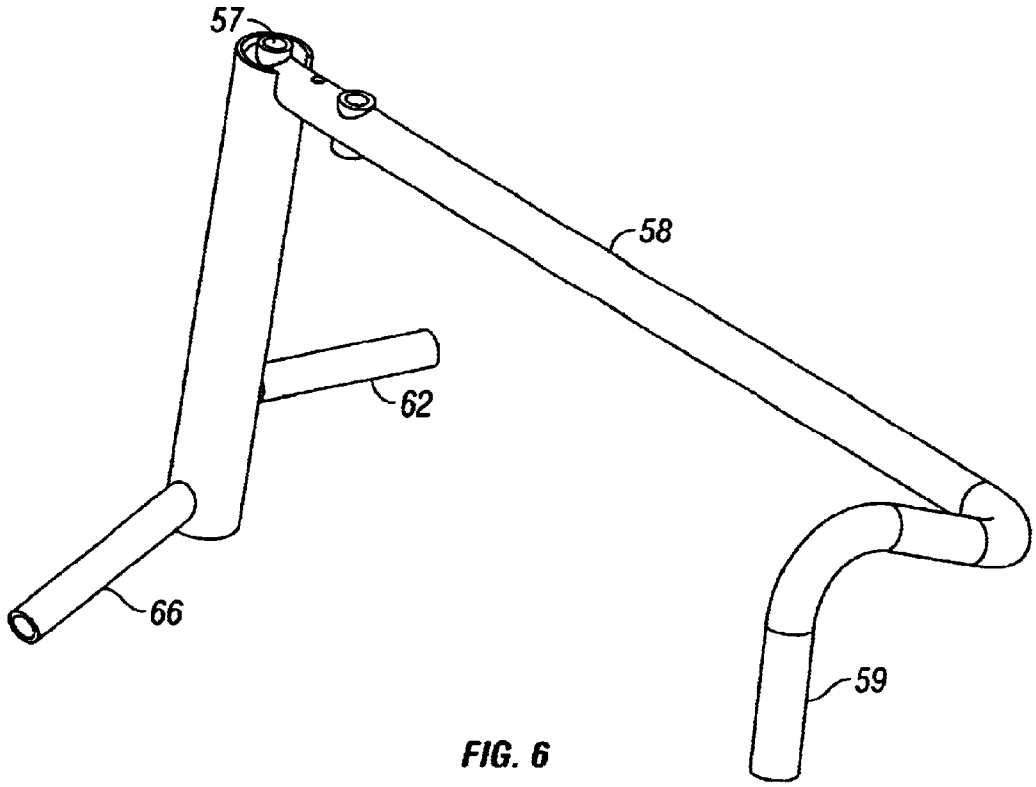
FIG. 6 is a perspective view of a right press handle in accordance with an embodiment of the present invention.

When the press arm assembly 50, explained in more detail with reference to FIGS. 4–6, is pushed away from its at-rest position, cable 26 raises the selected number of plates in the weight stack 20. This motion is shown in FIGS. 2 and 3, described further below. In a further preferred embodiment, the end of cable 26 terminating at the overhead pulley 114 includes a mechanism to attach an additional handle to cable 26 (not shown) to allow additional exercises to be performed against the resistance of cable 26.

Cable 28 engages composite pulley 104, a bottom directional pulley that is not shown, leg extender pulleys 116 and 118, and one end of cable 28 is fixed to bottom frame 16. The other end of cable 28 terminates at leg extender pulley 118. When leg extension/leg curl arm 30 is extended by an exercise motion of a user, cable 28 pulls downward on composite pulley 104, which in turn pulls cable 26, raising the selected number of weight plates in weight stack 20, providing resistance to the exercise motion. In a further preferred embodiment, the end of cable 28 terminating at leg extender pulley 118 includes a mechanism to attach an additional handle to cable 28 (not shown) to allow additional exercises to be performed against the resistance of cable 28.

In exercise machine 10, a press arm assembly 50 is pivotally attached to the frame via a primary pivot. The press arm assembly 50 comprises two vertical bars 52 and 54 that are pivotally connected to the frame, a main arm 56 that is fixedly connected to the two vertical bars 52 and 54, and two press handle assemblies 58 and 60 that are pivotally connected to the main arm 56 via secondary pivots. The two press handle assemblies 58 and 60 each includes a press handle 59 and 61, respectively. The press arm assembly 50 is discussed in greater detail with respect to FIGS. 4–6.

An exercise station is defined in exercise machine 10 by the location of the press handles 59 and 61. In the preferred embodiment, the exercise station includes an adjustable seat 32 attached to exercise station frame 18 and a fixed seat back 34 attached to vertical frame 14. A leg extension/leg curl arm 30 is pivotally connected to the exercise station frame 18 forward of the seat 32. The leg extension/leg curl arm 30 includes ankle pads 36 and 38 and knee pads 40 and 42. The leg extension/leg curl arm 30 is connected to, and receives resistance from, cable 28. As the leg extension/leg curl arm 30 is pivoted upward in an exercise motion, cable 28 pulls downward on composite pulley 104 which in turn pulls cable 26, raising the selected number of plates from weight stack 20, which provides resistance to the exercise motion.

Referring now to FIGS. 4–6, with continued reference to FIGS. 1–3, more detailed perspective views of the press arm assembly 50 are shown. The press arm assembly 50 includes vertical bars 52 and 54 fixedly connected to main arm 56. The press handle assemblies 58 and 60 are pivotally connected to main arm 56. The two press handle assemblies 58 and 60 each includes a press handle 59 and 61, respectively. Also connected to the press handle assemblies 58 and 60 are secondary handles 62, 64, 66, and 68 that can be used to perform additional exercises, such as back exercises, on the exercise machine 10.

The detail of the pivotal connection between press handle assemblies 58 and 60 and the main arm 56 is shown in FIG. 5 (the connection shown is between press handle assembly 58 and main arm 56). The press handle assembly 58 is pivotally connected to main arm 56 in proximity to pivot restrictor plate 70 which is fixedly connected to main arm 56. The press handle assembly 58 includes restrictor pin 72 and spring pin 78. The pivot restrictor plate 70 includes a slot 74 and a hole 76.

When the press handle assembly 58 is pivotally connected to the main arm 56, restrictor pin 72 engages slot 74 to restrict the range of pivot of press handle assembly 58. The spring pin 78 is aligned with hole 76, and when spring pin 78 engages hole 76, press handle assembly 58 remains in a fixed position with respect to main arm 56. Thus, exercises can be performed either with press handle assembly 58 pivoting over a predetermined range of motion when the spring pin 78 is not engaged with hole 76, or performed with press handle assembly 58 fixed with respect to the main arm 56 throughout the exercise by having the spring pin 78 engaged with hole 76 during the exercise motion.

It should be noted that, while the illustrated embodiment incorporates the pivot restrictor plate 70 on the main arm 56 and the restrictor pin 72 and spring pin 78 on the press handle assembly 58, alternate embodiments can incorporate these components on either of the main arm 56 and the press handle assembly 58.

Furthermore, different types of recesses can be used other than the hole 76 and slot 74 described herein to receive the restrictor pin 72 and spring pin 78. All that is required is that the components are able to interact to restrict the pivot of the press handle assembly 58 as described above.

FIG. 5 shows the detail of the connection between press handle assembly 58 and the main arm 56; however, the connection between press handle assembly 60 and the main arm 56 operates in the same fashion, as shown in FIG. 4. The press handle assembly 60 is pivotally connected to main arm 56 in proximity to pivot restrictor plate 80, which is fixedly attached to main arm 56. The press handle assembly 60 includes restrictor pin 82 and spring pin 88. The pivot restrictor plate 80 includes a slot 84 and a hole 86. When press handle assembly 60 is pivotally connected to main arm 56, restrictor pin 82 engages slot 84 to restrict the range of pivot of press handle assembly 60. The spring pin 88 is aligned with hole 86, and when spring pin 88 engages hole 86, press handle assembly 60 remains in a fixed position with respect to main arm 56. The operation of press handle assembly 60 during exercise is identical to that described with respect to press handle assembly 58 above. As described above with respect to the pivot of press handle assembly 58, the components can be configured in a number of ways to restrict the pivot of the press handle assembly 60 to create alternate embodiments of the present invention.

Referring now to FIG. 6, right press handle assembly 58 is shown. Press handle assembly 58 includes press handle 59 connected to the front of press handle assembly 58 and rear deltoid handle 62 and low row handle 66 connected to the rear of press handle assembly 58. Press handle assembly 58 also includes a rotation bushing 57 that pivotally connects press handle assembly 58 to main arm 56. Note that, while not separately shown, press handle assembly 60 has the same configuration as is shown for press handle 58, and is also connected to main arm 56 via a rotation bushing.

Referring now to FIGS. 2 and 3, the range of motion of the press arm assembly 50 is shown in three different positions. The spring pins 78 and 88 are disengaged from holes 76 and 86 in the illustrated motion. Thus, as the press arm assembly 50 is moved through an exercise motion, press handles 58 and 60 pivot with respect to main arm 56 through an angle of pivot defined by the range of motion of restrictor pins 72 and 82 within slots 74 and 84, respectively.

As discussed above, the press handle assemblies 58 and 60 are pivotally connected to the main arm 56 via rotation bushings (right rotation bushing 57 is shown in FIG. 6). The rotation bushings create secondary pivots that are orthogonal to the primary pivot of the main arm 56, and are angled inward toward each other with an intersection above the primary pivot when viewed from the front. This angle forces the press handles 59 and 61 to fall inward and downward together so that restrictor pins 72 and 82 rest against the end of slots 74 and 84, respectively, under the force of gravity in an at-rest position.

Furthermore, because the secondary pivots are angled inward, they do not line up with the pivot axis of the shoulder joint of an exerciser when he or she is performing converging presses and fly exercises. Instead, rotation of press handles 59 and 61 translate to movement of the main arm 56 at a constant rate, producing a constant resistance profile. The position and angle of the secondary pivots with respect to the primary pivot also allows for an approximately single plane motion when performing fly exercises because as the main arm 56 arcs upward, the downward angle of the secondary pivots causes the press handles 59 and 61 to move downward when brought together, essentially eliminating or greatly reducing arcing motion.

It is to be understood that a wide range of changes and modifications to the embodiments described above will be apparent to those skilled in the art, and these changes and modifications are contemplated herein. It is, therefore, intended that the foregoing detailed description be regarded as illustrative rather than limiting, and that it be understood that it is the following claims, including all equivalents, that are intended to define the spirit and scope of the invention.

I claim:

1. An exercise machine comprising:

a frame;

a weight stack slidably connected to the frame;

a pulley system;

one or more cables functionally engaged with the pulley system and the weight stack;

a press arm assembly connected with at least one of the cables such that when the press arm assembly is moved in an exercise motion, the weight stack provides resistance to the exercise motion, wherein the press arm assembly comprises:

a main arm pivotally connected with the frame; and one or more press handle assemblies pivotally connected with the main arm wherein the range of pivot of each press handle assembly is restricted;

a restrictor pin fixed to each of the press handle assemblies and a restrictor plate having a slot connected with the main press arm wherein the range of pivot of each press handle assembly is restricted by engaging the restrictor pin with the slot;

a spring pin connected with each of the press handle assemblies and the restrictor plate having a hole wherein the pivot of each press handle assembly is prevented by engaging the spring pin with the hole.

2. The exercise machine as claimed in claim 1, further comprising a leg extension/leg curl pedestal pivotally connected with the frame and connected with at least one of the cables such that when the leg extension/leg curl pedestal is pivoted, the weight stack provides resistance to the pivotal motion of the leg extension/leg curl pedestal.

3. The exercise machine as claimed in claim 2, further comprising a seat connected with the frame and defining an exercise station.

4. The exercise machine as claimed in claim 1, wherein the press handle assembly is connected with the main arm via a rotation bushing.

5. An exercise machine comprising:

a weight stack slidably connected to the frame;

a pulley system;

one or more cables functionally engaged with the pulley system and the weight stack; a press arm assembly connected with at least one of the cables such that when the press arm assembly is moved in an exercise motion, the weight stack provides resistance to the exercise motion, wherein the press arm assembly comprises:

a main arm pivotally connected with the frame;

a first restrictor plate connected with the main arm and having a slot;

a first press handle assembly pivotally connected with the main arm having a restrictor pin wherein the restrictor pin engages the slot on the restrictor plate to restrict the pivot arc of the first press handle assembly with respect to the main arm; and a spring pin connected with the first press handle assembly and the restrictor plate having a hole wherein the pivot of the first press handle assembly is prevented by engaging the spring pin with the hole.

6. The exercise machine as claimed in claim 5, further comprising:

a second restrictor plate connected with the main arm and having a slot; and a second press handle assembly pivotally connected with the main arm having a restrictor pin wherein the restrictor pin engages the slot on the second restrictor plate to restrict the pivot arc of the second press handle assembly with respect to the main arm.

7. The exercise machine as claimed in claim 6, further comprising a spring pin connected with the second press handle assembly and the second restrictor plate having a hole wherein the pivot of the second press handle assembly is prevented by engaging the spring pin with the hole.

8. The exercise machine as claimed in claim 7, further comprising a leg extension/leg curl pedestal pivotally connected with the frame and connected with at least one of the cables such that when the leg extension/leg curl pedestal is pivoted, the weight stack provides resistance to the pivotal motion of the leg extension/leg curl pedestal.

9. The exercise machine as claimed in claim 8, further comprising a seat connected with the frame and defining an exercise station.

10. The exercise machine as claimed in claim 6, wherein the pivot axis of the pivotal connection of the first press handle assembly to the main press arm and the pivot axis of the pivotal connection of the second press handle assembly to the main press arm are orthogonal to the primary pivot axis of the main arm and are angled inward toward one another such that the pivot axes of the first press handle assembly and the second press handle assembly will intersect above the primary pivot axis of the main arm.

11. An exercise machine comprising:

a frame;

a weight stack slidably connected to the frame; a pulley system;

one or more cables functionally engaged with the pulley system and the weight stack;

a press arm assembly connected with at least one of the cables such that when the press arm assembly is moved in an exercise motion, the weight stack provides resistance to the 69 exercise motion, wherein the press arm assembly comprises:

a main arm pivotally connected with the frame at a main pivot axis;

a first restrictor plate connected with the main arm and having a slot;

a first press handle assembly pivotally connected with the main arm at a first secondary pivot axis having a restrictor pin wherein the restrictor pin engages the slot on the first restrictor plate to restrict the pivot arc of the first press handle assembly with respect to the main arm;

a second restrictor plate connected with the main arm and having a slot; and a second press handle assembly pivotally connected with the main arm at a second secondary pivot axis having a restrictor pin wherein the restrictor pin engages the slot on the second restrictor plate to restrict the pivot arc of the second press handle assembly with respect to the main arm; and a spring pin connected with the first press handle assembly;

a hole in the first restrictor plate wherein the pivot of the first press handle assembly is prevented by engaging the spring pin of the first press handle assembly with the hole of the first restrictor plate;

a spring pin connected with the second press handle assembly; and a hole in the second restrictor plate wherein the pivot of the second press handle assembly is prevented by engaging the spring pin of the second press handle assembly with the hole of the second restrictor plate.

12. The exercise machine as claimed in claim 11, further comprising a leg extension/leg curl pedestal pivotally connected with the frame and connected with at least one of the cables such that when the leg extension/leg curl pedestal is pivoted, the weight stack provides resistance to the pivotal motion of the leg extension/leg curl pedestal.

13. The exercise machine as claimed in claim 12, further comprising a seat connected with the frame and defining an exercise station.

14. The exercise machine as claimed in claim 13, wherein the pulley system further includes a composite pulley that creates a predetermined weight ratio for the effective resistance of the weight stack with respect to the press arm assembly.

15. The exercise machine as claimed in claim 11, wherein the first secondary pivot axis and the second secondary pivot axis are orthogonal to the main pivot axis and are angled inward toward one another such that the secondary pivot axes will intersect above the main pivot axis.

* * * * *